US009521721B2

(12) United States Patent
Beczkowski

(10) Patent No.: US 9,521,721 B2
(45) Date of Patent: Dec. 13, 2016

(54) METHOD OF CONTROLING ILLUMINATION DEVICE BASED ON CURRENT-VOLTAGE MODEL

(71) Applicant: MARTIN PROFESSIONAL A/S, Aarhus N (DK)

(72) Inventor: Szymon Beczkowski, Aalborg (DK)

(73) Assignee: MARTIN PROFESSIONAL A/S, Aarhus N (DK)

( * ) Notice: Subject to any disclaimer, the term of this patent is extended or adjusted under 35 U.S.C. 154(b) by 0 days.

(21) Appl. No.: 14/346,352

(22) PCT Filed: Sep. 21, 2012

(86) PCT No.: PCT/DK2012/050352
§ 371 (c)(1),
(2) Date: Mar. 21, 2014

(87) PCT Pub. No.: WO2013/041109
PCT Pub. Date: Mar. 28, 2013

(65) Prior Publication Data

US 2014/0225529 A1 Aug. 14, 2014

(30) Foreign Application Priority Data

Sep. 23, 2011 (DK) ..... 2011 70529

(51) Int. Cl.
*H05B 33/08* (2006.01)

(52) U.S. Cl.
CPC ..... *H05B 33/0851* (2013.01); *H05B 33/0866* (2013.01); *H05B 33/0869* (2013.01)

(58) Field of Classification Search
CPC ..... H05B 33/0842; H05B 33/0815; H05B 33/0866; H05B 33/0869
(Continued)

(56) References Cited

U.S. PATENT DOCUMENTS 5,334,916 A 8/1994 Noguchi
7,315,139 B1 * 1/2008 Selvan et al. ..... 315/291
(Continued)

FOREIGN PATENT DOCUMENTS

CN 1763831 A1 4/2006
EP 0516398 A2 12/1992
(Continued)

OTHER PUBLICATIONS

International Search Report, PCT/DK2012/050352, Dec. 11, 2012.
Extended European Search Report Application No. 12 83 3232, dated Oct. 2, 2015, 8 pages.

*Primary Examiner* — Tung X Le
*Assistant Examiner* — Raymond R Chai
(74) *Attorney, Agent, or Firm* — Artegis Law Group, LLP

(57) ABSTRACT

The present invention relates to an illumination device including a number of LEDs and a processor for receiving an input signal and generating an activation signal for at least one of the LEDs based on the input signal. The illumination device further comprises an LED driver for obtaining the voltage across and current through the LED. The processor may generate the activation signal based on the voltage, the current and a current-voltage model related to the LED. The current-voltage model defines a relationship between the current, the voltage and the colorimetric properties of light emitted by the LED. The present invention relates also to a method of controlling and a method of calibrating such an illumination device.

22 Claims, 6 Drawing Sheets

(58) Field of Classification Search
USPC ..... 315/291, 297, 308
See application file for complete search history.

(56) References Cited

U.S. PATENT DOCUMENTS

| | | | | |
|---|---|---|---|---|
| 2003/0076056 | A1* | 4/2003 | Schuurmans | H05B 33/0869 315/291 |
| 2004/0239595 | A1 | 12/2004 | Vulto et al. | |
| 2006/0186819 | A1* | 8/2006 | Young | H05B 33/0866 315/158 |
| 2007/0040512 | A1 | 2/2007 | Jungwirth et al. | |
| 2007/0120496 | A1* | 5/2007 | Shimizu | H05B 33/0872 315/169.3 |
| 2007/0200513 | A1* | 8/2007 | Ha | H05B 33/0827 315/309 |
| 2008/0238340 | A1 | 10/2008 | Leung et al. | |
| 2008/0252571 | A1 | 10/2008 | Hente et al. | |
| 2009/0153075 | A1* | 6/2009 | Li | H05B 33/0818 315/294 |
| 2009/0284177 | A1* | 11/2009 | Pedersen | 315/297 |
| 2010/0097412 | A1* | 4/2010 | Okabe | G09G 3/3413 345/691 |
| 2011/0279749 | A1* | 11/2011 | Erinjippurath et al. | 349/61 |
| 2012/0268039 | A1* | 10/2012 | Chen | 315/308 |
| 2013/0342132 | A1* | 12/2013 | Jorgensen | H05B 37/02 315/297 |

FOREIGN PATENT DOCUMENTS

| | | | |
|---|---|---|---|
| WO | 2002080625 | A1 | 10/2002 |
| WO | 2005022500 | A1 | 3/2005 |
| WO | 2008029324 | A2 | 3/2008 |
| WO | 2010012999 | A2 | 2/2010 |

* cited by examiner

METHOD OF CONTROLING ILLUMINATION DEVICE BASED ON CURRENT-VOLTAGE MODEL

FIELD OF THE INVENTION

The present invention relates to an illumination device comprising a number of LEDs emitting light, means for receiving an input signal indicative of at least a color and/or brightness and means for generating an activation signal for at least one of the LEDs based on the input signal. The invention relates also to the method of controlling and a method of calibrating such illumination device.

BACKGROUND OF THE INVENTION

Light fixtures creating various effects are getting more and more used in the entertainment industry in order to create various light effects and mood lighting in connection with live shows, TV shows, sport events or as a part of an architectural installation.

Typically, such variable color light sources comprise a plurality of individually controllable light sources such that each individually controllable light source emits light of a predetermined color. For example, in an RGB system, the variable-color light source may comprise individually controllable light sources of the most common primary colors red, blue, and green. By controlling the relative brightness of the respective individually controllable light sources of the different primary colors almost any color in the visible spectrum may be generated by means of an additive mixing of the respective primary colors, resulting in output light of the desired color and intensity.

U.S. Pat. No. 6,016,038 and U.S. Pat. No. 6,806,659 disclose systems and methods related to LED systems capable of generating light, such as for illumination purposes. The light-emitting LEDs may be controlled by a processor to alter the brightness and/or color of the generated light, e.g., by using pulse-width modulated signals. The disclosed illumination device comprises LEDs including at least two different colors; a switching device, interposed between the LEDs and a common potential reference, including at least two switches corresponding to current paths of the two different color LEDs; a controller that opens and closes the switches according to a predetermined duty cycle. The LEDs of different colors are provided in LED sets each preferably containing serial/parallel array of LEDs of the same color and these LEDs are individual controllable by the controller.

Multi colored illumination devices as disclosed by U.S. Pat. No. 6,016,038 and U.S. Pat. No. 6,806,659 can generate many different colors and the illumination devices are typically instructed to create a target color and/or brightness (e.g. through an input signal indicative of a color and/or brightness). When light from several of such illumination devices are combined into one illumination (e.g. in order to illuminate architectural structure or a large stage area with the same color) color differences might occur even through the different illumination device are instructed to create the same target color. The reason for this is fact that it is difficult to manufacture light sources emitting the exact same color and brightness. This problem is a widely known issue in connection with LEDs and the LED manufacturers have assisted the illumination device providers by pre-sorting the LEDs into smaller ranges of variability prior to shipment. The sorting of the LEDs reduces the color and/or brightness variety of each batch of LEDs and illumination devices manufactured using the same batch of LEDs experience thus less color and/or brightness variations. However acceptable color and brightness rendering is still a demanding task because even the presorted batches of LED have a sizeable range of the performance variations and the cost of presorted batches are much higher than regular batches of LED. Further the end user combining multiple number of illumination devices may have illuminations from different production batches where different batches of LED have been used on the color and/or brightness variation of such illumination devices are even bigger.

It is known that it is possible to compensate for the differences in color and/or brightness of the type/color of LED in a multicolor illumination device by calibrating the illumination in connection with the manufacturing process. The calibration data define color and/or brightness properties of the LEDs and the illumination device is adapted to adjust the color and/or brightness of the LEDs based on the calibration data. Differences in color and/or brightness of the LEDs can hereby be taking into account when driving the illumination device. For instance U.S. Pat. No. 8,013,281 and WO 2007/062662 describes such systems.

U.S. Pat. No. 8,013,281 disclose a system and method for calibrating light output from a LED. The system includes a support on which a LED is positioned, a photosensor to measure the light output from the LED, and means for calibrating and adjusting the light output of the LED. Calibration is accomplished by measuring the light output from the LED, comparing such output against a reference value, and adjusting the measured output against the reference value.

WO 2007/062662 discloses a control device for controlling a variable-color light source, the variable-color light source comprising a plurality of individually controllable color light sources. The control device comprises a control unit for generating, responsive to an input signal indicative of a color and a brightness, respective activation signals for each of the individually controllable color light sources. The control unit is configured to generate the activation signals from the input signal and from predetermined calibration data indicative of at least one set of color values for each of the individually controllable light sources.

Further it is known that the color and/or brightness of the LEDs changes with the junction temperature of LED. Typically the LED manufactures provides information of how the color and/or brightness of the LED changes according the junction temperature. As a consequence the illumination is further adapted to adjust the color and/or brightness of the LEDs based on information provided by the manufactures and the junction temperature. However it is difficult to obtain a precise junction temperature of the LED, as it typical are estimated from a temperature measurement of the PCB whereon the LED is mounted and a temperature formula provided by the LED manufacture. There may thus still exits color and/or brightness variations in such illumination devices.

U.S. Pat. No. 7,626,345 discloses a manufacturing process for storing measured light output internal to an individual LED assembly, and an LED assembly realized by the process. The process utilizes a manufacturing test system to hold an LED light assembly a controlled distance and angle from the spectral output measurement tool. Spectral coordinates, forward voltage, and environmental measurements for the as manufactured assembly are measured for each base color LED. The measurements are recorded to a storage device internal to the LED assembly. Those stored measurements can then be utilized in usage of the LED assembly to provide accurate and precise control of the light output by the LED assembly.

Illumination devices where the color and/or brightness of the LEDs are regulated based on a live/online measurement of the outgoing light are also known. U.S. Pat. No. 6,894,442 disclose a light source and method for controlling the same. The light source utilizes a light generator that generates a light signal of a wavelength at an intensity that is set by a control signal. The control signal is controlled by a servo that monitors the light output of the light generator and compares the monitored value with a target value. When the target value is changed, the control signal is initially replaced by a predicted control signal based on the new target value rather than the error signal generated in the servo. This provides time for the servo to adjust to the new target value. In one embodiment, the control signal includes a periodic signal that switches between a value that causes the light generator to generate light of the wavelength and a second value at which the light generator does not generate light of the wavelength.

Systems, like the one disclosed by U.S. Pat. No. 6,894,442, where the intensity of the light sources are regulated based live/online measurement of the light generated by the light sources are also disclosed by WO02/080625, US2007/0108846, WO2008/153642 and WO 02/47438 (all briefly described below). In general, such system are complicated to implement as it requires that the photo sensors do not measure ambient light or that the system account for ambient light. However, the is very difficult in connection with entertainment shows where the ambient light changes often as light from neighboring lamps may hit the light fixture and thus influence the light measurements. The photo sensors themselves may also introduce error if they also are not calibrated correctly and/or or provides measurements with large tolerances. The photo sensors and required techniques also adds thus extra costs to the light fixture, for instance as accurate photo sensor with low tolerances are expensive.

WO 02/080625 discloses a system for controlling a RGB based LED luminary which tracks the tristimulus values of both feedback and reference whereby the forward currents driving the LED luminary are adjusted in accordance with the errors between the feed tristimulus values and the reference tristimulus values until the errors are zero.

US 2007/0108846 disclose a method and system for controlling the chromaticity and luminous flux output of a digitally controlled luminaire. The luminaire comprises one or more light-emitting elements and one or more light sensors which can provide optical feedback, wherein this optical feedback is filtered to remove undesired frequencies. The method and system comprises a control system which can sample the filtered signals from the light sensors according to a predetermined feedback sampling frequency scheme, wherein this scheme is specifically configured to provide sufficient iterations of the feedback loop to be performed for adjustment of the chromaticity and luminous flux output of the light-emitting elements, without perceptible visual flicker or momentary chromaticity shifts.

WO 2008/153642 discloses a method of calibrating a lighting panel including a plurality of segments, a respective segment configured to emit a first color light and a second color light in response to pulse width modulation control signals having respective duty cycles, includes activating the plurality of segments to simultaneously emit the first and second colors of light. A combined light output for the plurality of segments is measured at a measurement location to obtain aggregate emission data. Separate emission data for the first and second colors of light is determined based on the aggregate emission data. For example, the separate emission data for the first and second colors of light may be derived based on extrapolation of the aggregate emission data and expected emission data for the first and second colors of light. Related calibration systems are also discussed.

WO 02/47438 discloses, a LED luminary system for providing power to LED light sources to generate a desired light color comprises a power supply stage configured to provide a DC current signal. A light mixing circuit is coupled to said power supply stage and includes a plurality of LED light sources with red, green and blue colors to produce various desired lights with desired color temperatures. A controller system is coupled to the power supply stage and is configured to provide control signals to the power supply stage so as to maintain the DC current signal at a desired level for maintaining the desired light output. The controller system is further configured to estimate lumen output fractions associated with the LED light sources based on junction temperature of the LED light sources and chromaticity coordinates of the desired light to be generated at the light mixing circuit. The light mixing circuit further comprises a temperature sensor for measuring the temperature associated with the LED light sources and a light detector for measuring lumen output level of light generated by the LED light sources. Based on the temperatures measured, the controller system determines the amount of output lumen that each of the LED light sources need to generate in order to achieve the desired mixed light output, and the light detector in conjunction with a feedback loop maintains the required lumen output for each of the LED light sources.

DESCRIPTION OF THE INVENTION

The object of the present invention is to solve the above described limitations related to prior art. This is achieved by an illumination device and a method of controlling an illumination device as defined in the independent claims. The dependent claims describe possible embodiments of the present invention. The advantages and benefits of the present invention are described in the detailed description of the invention.

DETAILED DESCRIPTION OF THE INVENTION

Figure 1:
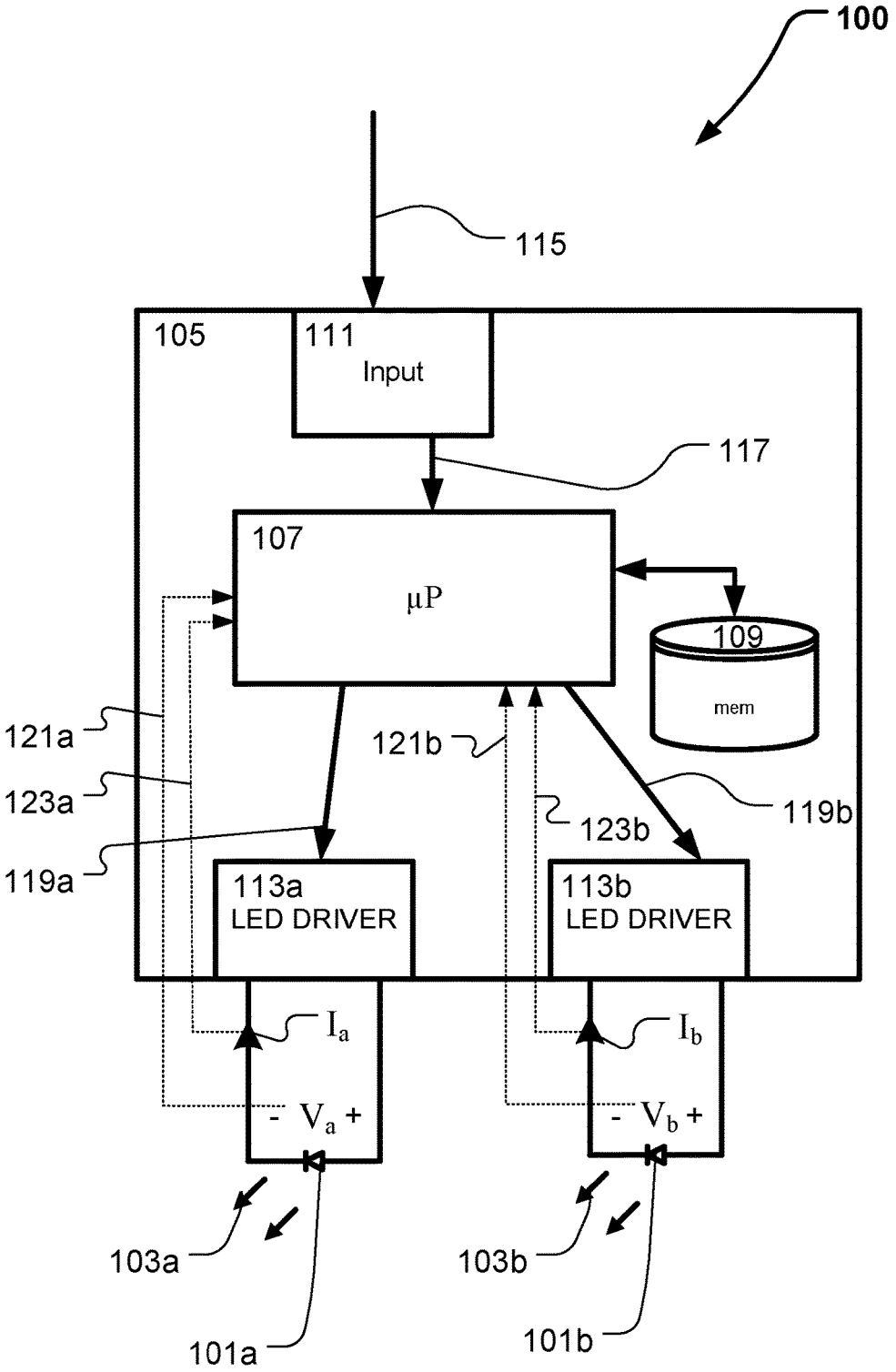
FIG. 1 illustrates an illumination device according to the present invention.

FIG. 1 illustrates a structural block diagram of an illumination device 100 according the present invention. The illumination device comprises a first LED 101*a* emitting light 103*a* having a first color and a second LED 101*b* emitting light 103*b* having a second color.

The illumination device comprises a control unit 105 comprising a processor 107, a memory 109, receiving means 111, a first LED driver 113*a* and a second LED driver 113*b*.

The receiving means 111 is adapted to receive an input signal 115 indicative of a number of control parameters relating to at least a color and/or brightness of the light, which the illumination device must create. However the input signal may also be indicative of parameters such as strobing, position (in cases the illumination device is a moving head light fixture), light effects, predetermined light effect functions or other kind of parameters known in the art of intelligent lighting. The input signal can for instance be based on the DMX, ARTnet, Ethernet or any other communication protocol. The receiving means is thus adapted to extract the control parameters from the input signal 115 and to pass the control parameters to the processor 105 as illustrated by arrow 117. Alternatively the input signal can also be an electronic signal internally within the illumination device for instance carried on a databus transmitting data from an internally memory. This makes it possible to provide a stand-alone illumination device where the controlling instructions are stored in the memory.

The light from the first and second LEDs can be combined into a light beam and the processor can control the color of the light beam by regulating the intensity of the illumination as known form the art of additive color mixing. The processor 107 is thus adapted to control the first 101*a* and second 101*b* LEDs based on the control parameters received from the input signal 115 and is adapted to pass a first control signal 119*a* and a second control signal 119*b* respectively to the first LED driver 113*a* and the second LED driver 113*b*.

The first LED driver 113*a* is adapted to generate a first activation signal for the first LED 101*a* and the first LED 101*a* emits light 103*a* in response to the first activation signal. The second LED driver 113*b* is adapted to generate a second activation signal for the second LED 101*b* and the second LED 101*b* emits light 103*b* in response to the second activation signal. The first and second activation signal may be any electrical signal respectively capable of activating the first 103*a* and second 103*b* LEDs. For instance the first and second LED driver can be adapted to force current $I_a$ and $I_b$ through the first and second LEDs whereby the LEDs will emit light. As consequence a voltage $V_a$ and $V_b$ are generated across the first and second LEDs. The first and second activating signals are thus controlled by the processor and the intensity of each LED can be increased by increasing the current and be decreased by decreasing the current. The current can be regulated as a DC, AC, PWM or any combinations as known in the art of intelligent lighting and power electronics.

The illumination device comprises also means for obtaining the first voltage $V_a$ across said first LED and means for obtaining a first current $I_a$ through the first LED. These means are further adapted to passed values indicative of the first voltage $V_a$ and the first current $I_a$ to the processor 107 respectively illustrated by dotted arrows 121*a* and 123*b*.

Similar means for obtaining the second voltage $V_b$ across the second LED and means for obtaining the second current $I_b$ through the second LED are provided. These means are also adapted to pass values indicative of the second voltage $V_b$ and second current $I_b$ to the processor 107 respectively illustrated by dotted arrows 121*b* and 123*b*. In the illustrated embodiment these means are embodied as known in the art of electronic measuring means and adapted to measure the first voltage $V_a$, the first current $I_a$, the second voltage $V_b$ and the second current $I_b$ directly but the values can also be obtained indirectly from other measurements and a number of calculations. Further the means for obtaining the currents can be adapted to obtain the currents $I_a$ or $I_b$ from the first control signal 119*a* and/or a second control signal 119*b*, as the first and sand second control signal can be indicative of the first current $I_a$ and second current $I_b$. Additionally the means for obtaining the first current and second currents can be adapted to obtain the currents $I_a$ or $I_b$ from the LED drivers 113*a* or 113*b*, as the LED drivers sets the current through the LEDs. Also the means for obtaining the first current and second currents can be adapted to obtain the first and second current from/within the processor, as the processor can be adapted to set the first and second current.

In the illumination device according to the present invention the processor 107 is further adapted to control the first 101*a* LED based on the first voltage $V_a$, the first current $I_a$ and a first current-voltage model. The first current-voltage model is stored in the memory 109 and defines a first relationship between the first current $I_a$, the first voltage $V_a$ and colorimetric properties of light emitted by first LED. The processor uses the first current $I_a$ and the first voltage $V_a$ parameters as inputs to the current-voltage model and receives colorimetric properties related the first LED when driven at the first voltage $V_a$ and the first current $I_a$. The processor generates thus the first control signal 119*a* based on the first voltage $V_a$, first current $I_a$ and first current-voltage model and as a consequence the first LED driver generates the first activation signal based on these parameters.

Similar the processor is adapted to control the second LED based on the second voltage $V_b$ and the second current $I_b$ and a second current-voltage model. The second current-voltage model is stored in the memory 109 and defines a second relationship between the second current $I_b$, the second voltage $V_b$ and colorimetric properties of light emitted by second LED. The processor uses the second current $I_b$ and the second voltage $V_b$ parameters as inputs to the current-voltage model and receives colorimetric properties related the second LED when driven at the second voltage $V_b$ and the second current $I_b$. The processor is then adapted to create the second control signal 119*b* based on the second voltage $V_b$, second current $I_b$ and second current-voltage model and as a consequence the second LED driver generates the second activation signal based on these parameters.

As a consequence the color and/or brightness of the illumination device can be controlled very accurately and precisely under different driving conditions for instance due to changes in ambient conditions. This is achieved as changes in colorimetric properties of the light from the first and second LEDs can be taken into account when controlling the illumination device and the change in colorimetric properties can be determined very accurately based on the first and second current-voltage models.

The current-voltage relationship of a LED and the colorimetric properties of the emitted light depends on driving conditions, ambient parameters like temperature, humidity, the illumination device's capability of removing heat from the LED. Changes in these parameters results in a change of both the current-voltage relationship and the colorimetric properties of the emitted light of the LED. The inventor has showed both the current-voltage relationship and the colorimetric properties of the emitted light are proportional to changes in these parameters and that the colorimetric properties of the emitted light are substantial constant for each current-voltage relationship. The inventor have further showed that it is possible to determine the colorimetric propertied of the emitted light based on the current-voltage relationship and current-voltage model related to the LED, where the current-voltage model have been derived by from a number of the measurements of the current-voltage relationship and the corresponding colorimetric properties of the emitted light. In other words the combination of voltage and current results in the same colorimetric properties color and brightness The LEDs can thus be driven very accurately as the voltage and current can be measured directly related to the LED which makes it possible to provide a very accurate calibration of the LED. Further this makes it possible to avoided calibrating the LED based on its temperature and/or other ambient parameters which reduces the complexity of the illumination device and also provides a very accurate calibration.

The current-voltage model may be embodied as a look-up table comprising a number of calibration points, where each calibration point comprises a measured voltage and measured current and measured colorimetric properties of light emitted from the LED driven at the measured voltage and current. The calibration points may be obtain according to a calibration method as described in connection with FIG. 6) For instance the measured colorimetric properties can be values which describes the color and/or spectra of the emitted light for instance tristimulus values in a color space (CIE 1931 color space; CIE 1976 color space etc.), hue, saturation and brightness values of a color circle/wheel. As an example the look up table may be embodied as a table where the for each combination of measured voltage and current the tristimulus values X, Y, Z in a color space may be stored as sets in a look up table. The processor can be adapted to identify the data set which has voltage and current values closest to the obtained voltage and current values and control the LEDs based on these values.

TABLE 1 example of look up table

| Current [A] | Voltage [V] | X [no units] | Y [no units] | Z [no units] |
|---|---|---|---|---|
| 0.081 | 2.623 | 0.006 | 0.023 | 0.002 |
| 0.153 | 2.784 | 0.009 | 0.040 | 0.005 |
| 0.227 | 2.902 | 0.013 | 0.057 | 0.007 |
| 0.301 | 2.993 | 0.016 | 0.071 | 0.009 |
| 0.374 | 3.069 | 0.019 | 0.085 | 0.012 |
| 0.446 | 3.131 | 0.022 | 0.096 | 0.014 |
| 0.517 | 3.188 | 0.024 | 0.105 | 0.015 |
| 0.586 | 3.233 | 0.026 | 0.113 | 0.017 |
| 0.656 | 3.277 | 0.028 | 0.121 | 0.019 |
| 0.725 | 3.315 | 0.029 | 0.128 | 0.020 |
| 0.082 | 2.602 | 0.006 | 0.025 | 0.002 |
| 0.153 | 2.759 | 0.010 | 0.042 | 0.005 |
| 0.227 | 2.873 | 0.014 | 0.058 | 0.007 |
| 0.302 | 2.964 | 0.017 | 0.072 | 0.009 |
| 0.374 | 3.036 | 0.020 | 0.084 | 0.011 |
| 0.446 | 3.096 | 0.022 | 0.095 | 0.013 |
| 0.517 | 3.148 | 0.024 | 0.104 | 0.015 |
| 0.587 | 3.195 | 0.026 | 0.112 | 0.017 |
| 0.656 | 3.238 | 0.028 | 0.120 | 0.018 |
| 0.725 | 3.279 | 0.030 | 0.127 | 0.019 |
| 0.081 | 2.583 | 0.006 | 0.024 | 0.002 |
| 0.153 | 2.735 | 0.010 | 0.042 | 0.005 |
| 0.227 | 2.846 | 0.014 | 0.057 | 0.007 |
| 0.302 | 2.935 | 0.017 | 0.071 | 0.009 |
| 0.374 | 3.004 | 0.020 | 0.083 | 0.011 |
| 0.446 | 3.063 | 0.022 | 0.094 | 0.013 |
| 0.516 | 3.115 | 0.024 | 0.103 | 0.014 |
| 0.586 | 3.161 | 0.026 | 0.111 | 0.016 |
| 0.656 | 3.203 | 0.028 | 0.118 | 0.018 |
| 0.725 | 3.241 | 0.030 | 0.125 | 0.019 |

TABLE 1-continued example of look up table

| Current [A] | Voltage [V] | X [no units] | Y [no units] | Z [no units] |
|---|---|---|---|---|
| 0.081 | 2.562 | 0.006 | 0.024 | 0.002 |
| 0.153 | 2.711 | 0.010 | 0.041 | 0.004 |
| 0.227 | 2.821 | 0.014 | 0.056 | 0.007 |
| 0.301 | 2.908 | 0.017 | 0.070 | 0.009 |
| 0.374 | 2.977 | 0.020 | 0.082 | 0.011 |
| 0.446 | 3.036 | 0.022 | 0.092 | 0.012 |
| 0.516 | 3.087 | 0.025 | 0.101 | 0.014 |
| 0.586 | 3.132 | 0.027 | 0.110 | 0.016 |
| 0.656 | 3.175 | 0.028 | 0.117 | 0.017 |
| 0.725 | 3.212 | 0.030 | 0.124 | 0.018 |
| 0.081 | 2.541 | 0.006 | 0.023 | 0.002 |
| 0.154 | 2.690 | 0.010 | 0.040 | 0.004 |
| 0.227 | 2.796 | 0.014 | 0.055 | 0.006 |
| 0.301 | 2.882 | 0.017 | 0.069 | 0.008 |
| 0.374 | 2.951 | 0.020 | 0.081 | 0.010 |
| 0.446 | 3.009 | 0.023 | 0.091 | 0.012 |
| 0.517 | 3.061 | 0.025 | 0.100 | 0.014 |
| 0.587 | 3.107 | 0.027 | 0.108 | 0.015 |
| 0.657 | 3.149 | 0.029 | 0.115 | 0.016 |
| 0.725 | 3.186 | 0.030 | 0.122 | 0.018 |
| 0.082 | 2.524 | 0.006 | 0.023 | 0.002 |
| 0.154 | 2.667 | 0.010 | 0.040 | 0.004 |
| 0.227 | 2.772 | 0.014 | 0.054 | 0.006 |
| 0.301 | 2.857 | 0.017 | 0.068 | 0.008 |
| 0.374 | 2.925 | 0.020 | 0.079 | 0.010 |
| 0.446 | 2.984 | 0.023 | 0.089 | 0.012 |
| 0.517 | 3.035 | 0.025 | 0.098 | 0.013 |
| 0.587 | 3.080 | 0.027 | 0.106 | 0.015 |
| 0.656 | 3.121 | 0.029 | 0.114 | 0.016 |
| 0.726 | 3.158 | 0.030 | 0.120 | 0.017 |

It is noted that the look table may comprise less or more calibration points. And that the XYZ values can be calculated into luminance by multiplying the values with 683.

The current voltage may also be carried out as a current-voltage function where the inputs to the function are voltage across and current through the LED and where the output is a colorimetric property of the emitted light. The current-voltage can be derived based on a number of calibration points comprising a measured voltage and measured current and measured colorimetric properties of light emitted from the LED driven at the measured voltage and current. The current-voltage function can be a polynomial fitted to the function calibration points. The current-voltage function may be defined by the following equation:

$$\begin{bmatrix} X \\ Y \\ Z \end{bmatrix} = \begin{bmatrix} a_{0,X} \\ a_{0,Y} \\ a_{,0,Z} \end{bmatrix} + \begin{bmatrix} a_{1,X} \\ a_{1,Y} \\ a_{1,Z} \end{bmatrix} I + \begin{bmatrix} a_{2,X} \\ a_{2,Y} \\ a_{2,Z} \end{bmatrix} I^2 + \begin{bmatrix} a_{3,X} \\ a_{3,Y} \\ a_{3,Z} \end{bmatrix} I^3 + \begin{bmatrix} a_{4,X} \\ a_{4,Y} \\ a_{4,Z} \end{bmatrix} V + \begin{bmatrix} a_{5,X} \\ a_{5,Y} \\ a_{5,Z} \end{bmatrix} V^2 \quad \text{Eq. 1}$$

where X Y Z is the tristimulus values of the emitted light, V is the voltage across the LED and I the current through the LED. The constants $a_{0,X}$-$a_{5,Z}$ are determined by fitting the calibrations point to the polynomial function. The equation makes it possible to determine the tristimiulus values of the emitted light based on the voltage across and the current through the LED. The processor of the illumination device can be adapted to control the intensity of the LEDs according to this. The current-voltage function makes it possible to estimate the colorimetric property of the emitted light at points which have not been measured and the number of calibration can thus be reduced.

Example of Current-Voltage Function of LED

The fact that the forward voltage of a diode is proportional to both junction temperature and forward current and that the diode colorimetric properties are dependent on junction temperature and forward current makes it possible to construct a model that estimates colorimetric properties based only on instantaneous values of diode's current and voltage. Diodes' tristimulus properties and forward voltage have to be measured at various junction temperatures and, if AM or hybrid dimming is to be used, various current levels in order to create a model. A test diode was placed on thermally controlled heatsink. The temperature was set in increments of 10° C. in the 5-55° C. range. The current was controlled in the 10-100% of nominal current range allowing the diode to reach thermal steady state after each change. At that point current, voltage and tristimulus values were measured. Four wire setup was used to gather electrical parameters in order to avoid voltage drop on terminals and cables.

The collected data was fitted to a polynomial vector function as described above in equation Eq. 1. The constants $a_{0,X}$-$a_{5,Z}$ were determined based on the collected data and the constants are summarized in the table 2 below:

TABLE 2 constant values of Eq. 1 of single LED

| | $a_0$ | $a_1$ | $a_2$ | $a_3$ | $a_4$ | $a_5$ |
|---|---|---|---|---|---|---|
| X | −21,6016 | 49,4033 | −35,9338 | 13,7914 | 17,8229 | −3,5965 |
| Y | 64,4199 | 150,4281 | −126,8380 | 48,3485 | −63,3557 | 15,6206 |
| Z | 44,5720 | 15,3010 | −11,6136 | 4,8460 | −36,8834 | 7,6600 |

The higher order of polynomial used to represent the data the more computational power is required to use the model. Also the model may be over fitted in which case the measurement error would be visible in the model.

Figure 2A:
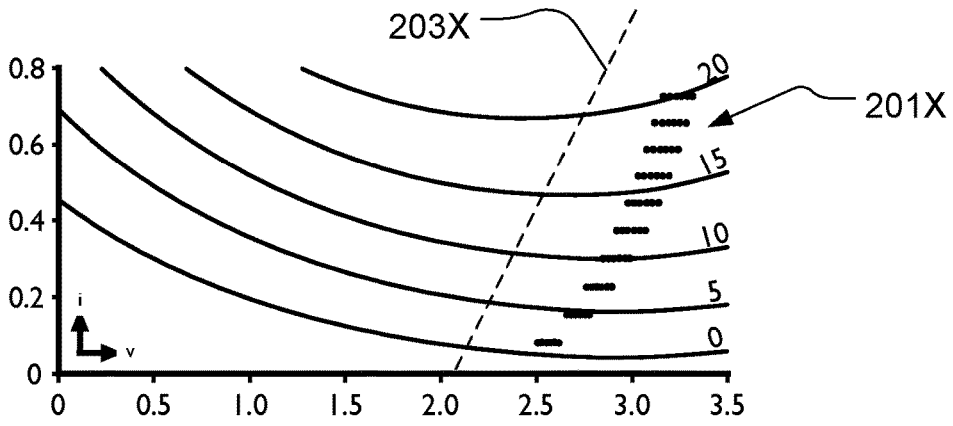
FIG. 2*a*-2*c* illustrate a number of current-voltage functions of a LED.
Figure 2B:
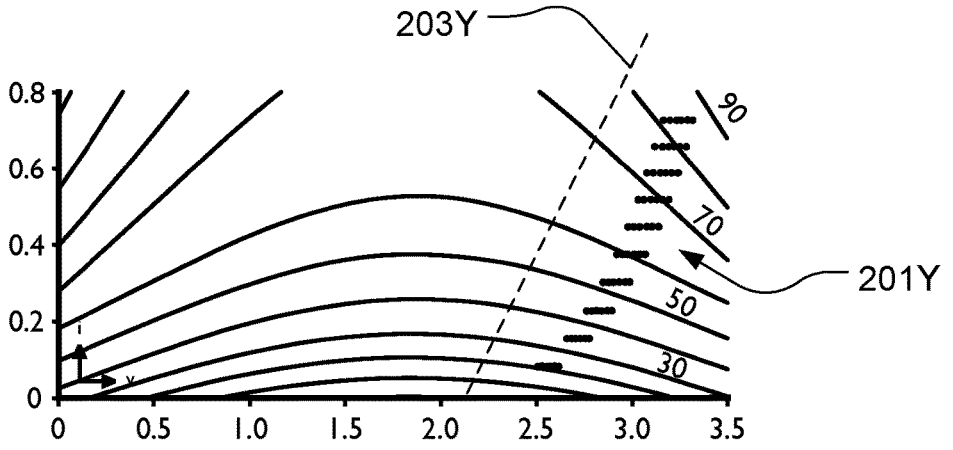
Figure 2C:
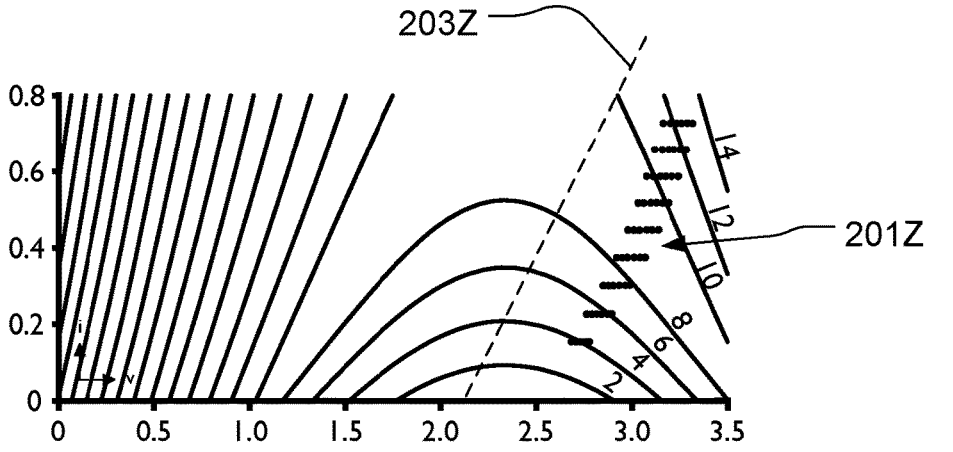

FIG. 2*a-c* illustrates contour plots of the XYZ tristimulus values as a function of current through and voltage across the LED and as defined by the polynomial vector function with the constants indicated in table 2. FIG. 2*a* illustrates the X tristimulus value, FIG. 2*b* Y illustrated the Y tristimulus value and FIG. 2*c* illustrates the Z trisimulus value. The contour plots show that the all of the XYZ tristimulus values changes when the current through and voltage across changes. The dots 201X, 201Y and 201Z indicated in the three contour plots represent the measures values used to create the polynomial function. It is noted that the polynomial vector function is most accurate in the vicinity of the measured points and the polynomial functions may not hold in areas far from the measured points. For instance some current and voltage values many not be obtained due to physical restraints in the LED and the corresponding part of the polynomial function will thus never be uses, as these values are never obtained. For instance in typical driving situation the model may never be applied at current-voltage values left of the dashed lines 203X, 203Y, 203Z indicated in the figures.

In order to test the accuracy of the model created in DC current conditions the test diode was driven with a PWM current with various duty cycles. The frequency of PWM waveform is approximately 200 Hz. Before each measurement the diode was allowed to reach thermal steady state. Optical parameters were measured by integrating over multiple PWM periods. Current and voltage waveforms were recorded with 250 kS/s speed with 12 bit ADC. Few periods were extracted from the waveforms and instantaneous current and voltage values were converted to tristimulus values using the previously created model. Resulting data was integrated and divided by the measured time period to obtain average tristimulus values and the resulting color point.

Results, summarized in table 3 below, show that the model accurately predicts the color shift of the diode. It is therefore possible to use this model to predict the color and color shift of the emitted light at different driving conditions. As a consequence the current-voltage model can be used to account for color shift due to changing driving condition of the LED.

TABLE 3 measured and model XYZ values.

| | measured | | | modeled | | | |
|---|---|---|---|---|---|---|---|
| duty cycle | X [lumen] | Y [lumen] | Z [lumen] | X [lumen] | Y [lumen] | Z [lumen] | $\Delta E_{ab}$* |
| 0.25 | 5,0220 | 21,1250 | 3,1755 | 4,9959 | 21,2062 | 3,2113 | 0,7180 |
| 0.50 | 10,2578 | 42,4024 | 6,2815 | 10,2247 | 42,4012 | 6,3039 | 0,2716 |
| 0.75 | 15,5399 | 63,1550 | 9,2266 | 15,5314 | 63,1397 | 9,2375 | 0,0545 |
| 1.00 | 20,7462 | 82,9354 | 11,9647 | 20,7622 | 82,6360 | 11,8799 | 0,7566 |

where Z, Y, Z values are coordinates in the 1976 CIE color diagram and $\Delta E^*_{ab}$ is color difference expressed as the length of a vector connecting the a point defined by the measured values and the point defined by the modeled values.

The number of measurement points needed to describe diode's behavior depends on the complexity of the model and the desired operating point. If the diode is to be dimmed using PWM scheme, it is sufficient to measure the parameters at single forward current with varying heat sink temperature.

If the radiometric power of the emitted light is also modeled, it may be used together with the thermal model of the system to completely describe luminaire's behavior. Subtracting the optical power from input electrical power gives the power losses in the diode structure. This loss will create a temperature rise with respect to heat sink temperature according to the thermal description of the heat flow path. Resulting temperature increase in the junction can be translated into forward voltage change resulting in a new operating point to be fed back to the current-voltage model.

Very often luminaire consists of strings of series connected light-emitting diodes. It is possible to model each diode separately and adjust the current through the string based on a combination of these current-voltage models for each LED. However in connection with light fixtures having a large number of LEDs may it may be a time consuming process to collect the calibration points.

A current-voltage of the whole string would therefore be beneficial.

Example of current-voltage function of LED String

A similar measurement was performed on a LED string comprising three LEDs from the same batch. In this embodiment the current through the LED string and the voltage across all three LEDs was measured. The XYZ tristimulus values of the lighter emitted by all three LED were measured at the corresponding voltage and current values.

The collected data was fitted to a polynomial vector function as described above in equation Eq. 1. The constants $a_{0,X}$-$a_{5,Z}$ were determined based on the collected data and the constants are summarized in the table 4 below:

TABLE 4 constant values of Eq. 1 for string of three LED.

| | $a_0$ | $a_1$ | $a_2$ | $a_3$ | $a_4$ | $a_5$ |
|---|---|---|---|---|---|---|
| X | −252,8207 | 258,1163 | −208,6552 | 103,2652 | 69,6372 | −4,7233 |
| Y | 90,8846 | 825,3661 | −726,7483 | 327,8889 | −56,0428 | 6,4406 |
| Z | 307,8647 | 96,6934 | −66,5980 | 35,1820 | 88,3342 | 6,3342 |

The higher order of polynomial used to represent the data the more computational power is required to use the model. Also the model may be over fitted in which case the measurement error would be visible in the model.

Figure 3A:
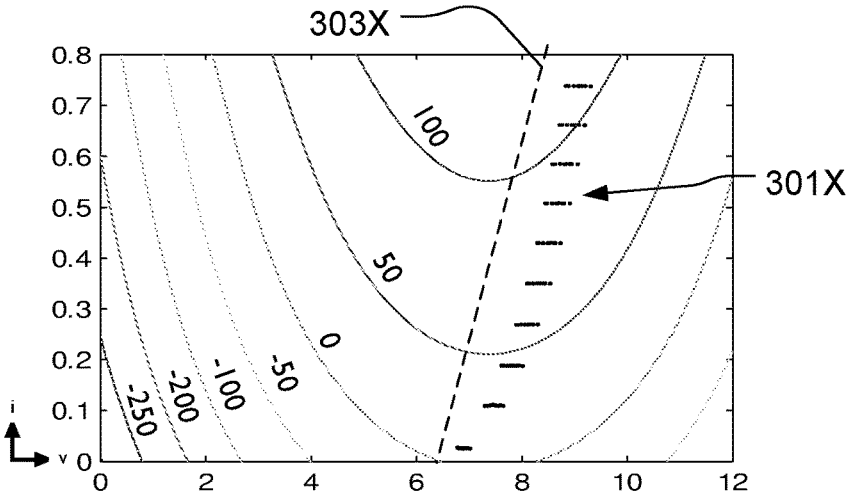
FIG. 3*a*-3*c* illustrated a number of current-voltage functions of a string of LEDs.
Figure 3B:
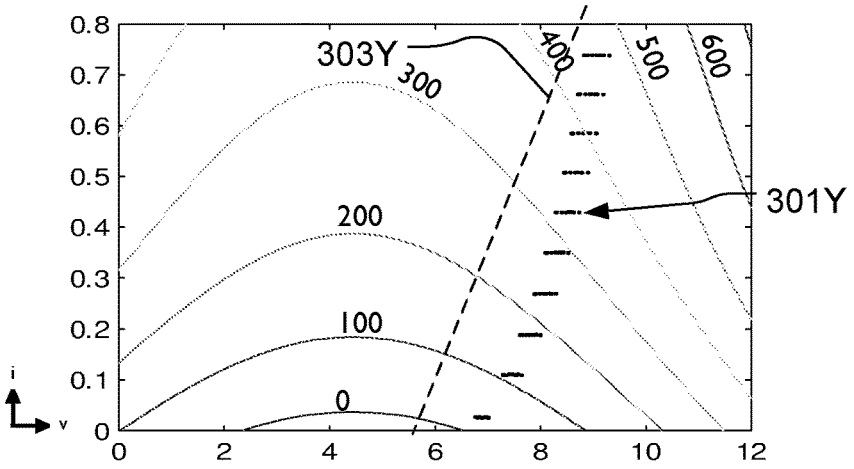
Figure 3C:
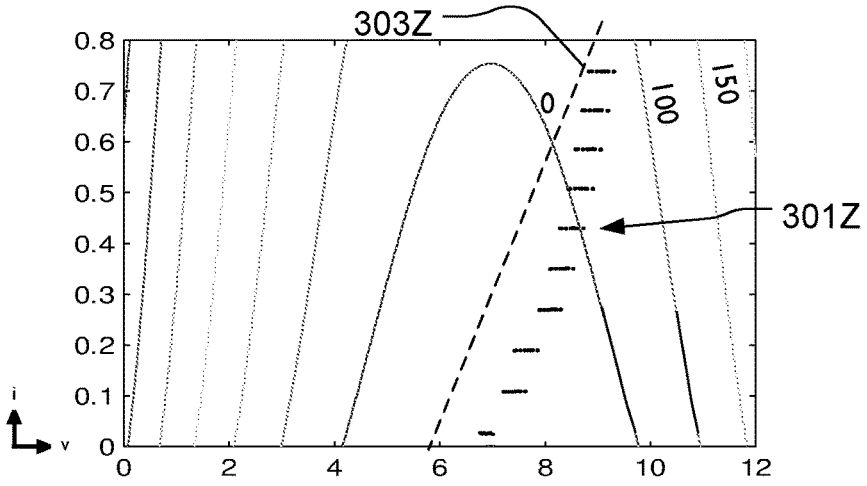

FIG. 3*a-c* illustrates contour plots of the XYZ tristimulus of the values as a function of current through and voltage across the string of LEDs and as defined by the polynomial vector function with the constants indicated in table 4. FIG. 3*a* illustrates the X tristimulus value, FIG. 3*b* Y illustrated the Y tristimulus value and FIG. 3*c* illustrates the Z tristimulus value. The contour plots show that all of the XYZ tristimulus values changes when the current through and voltage across changes. The dots 301X, 301Y and 301Z indicated in the three contour plots represent the measures values used to create the polynomial function. It is noted that the polynomial vector functions are most accurate in the vicinity of the measured points and the polynomial functions may not hold in areas far from the measured points. For instance some current and voltage values many not be obtained due to physical restraints in the LED and the corresponding parts of the polynomial functions will thus never be uses, as these values are never obtained. For instance in typical driving situation the model may never be applied at current-voltage values left of the dashed lines 303X, 303Y, 303Z indicated in the figures.

Figure 4:
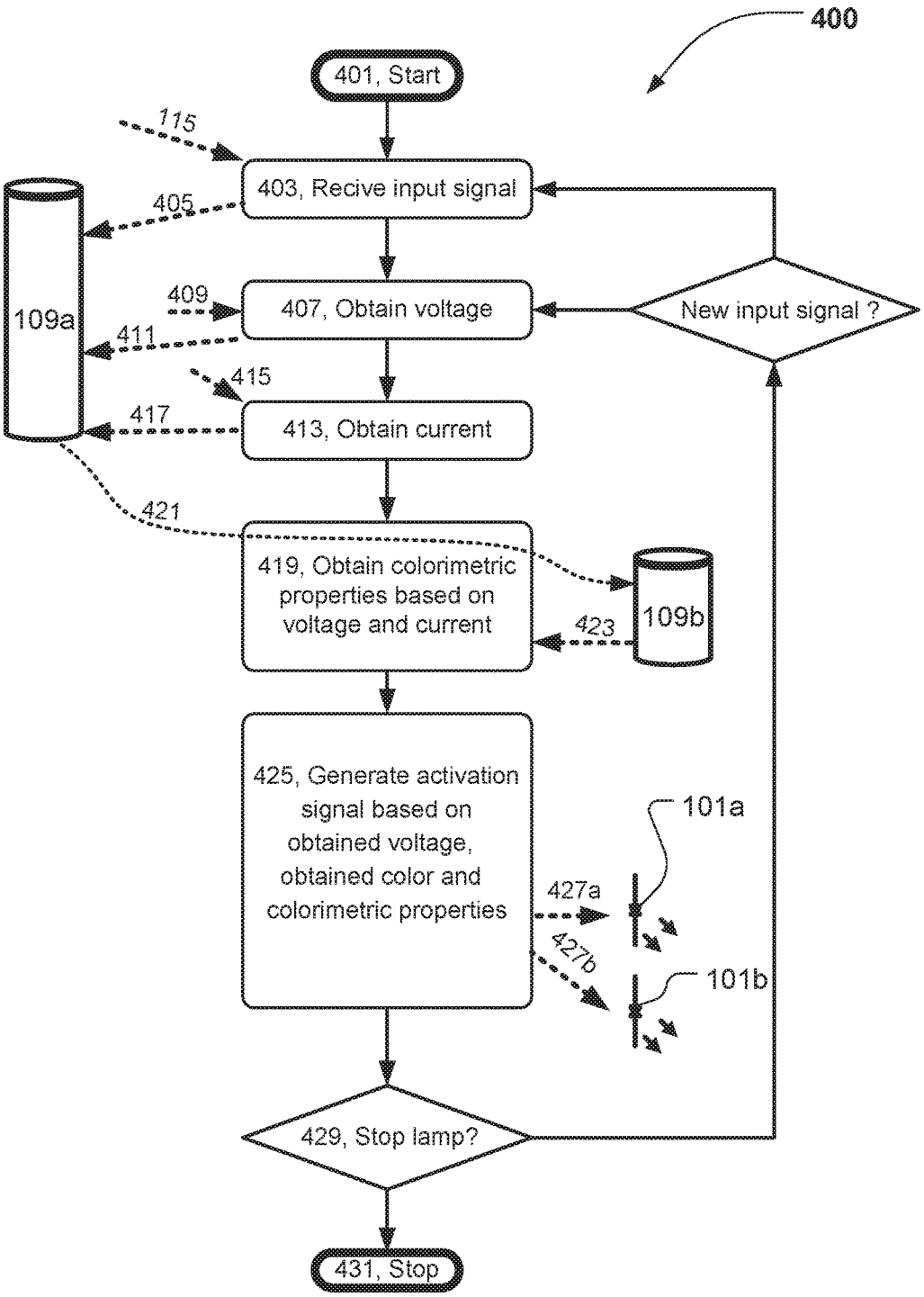
FIG. 4 illustrates a flow diagram of a method of controlling an illumination device according to the present invention.

FIG. 4 illustrates a flow diagram of a method 400 according to the present invention and which for instance can be used to control the illumination device illustrated in FIG. 1.

Initially 401 the processor is adapted to start and set the illumination device according to a predetermined initialization. The illumination device then receives an input signal 115 indicative of a number of control parameters indicative of at least color and/or brightness as described above. The illumination device extracts in step 403 the color and/or brightness parameters from input signal and stores 405 the color and/or brightness parameters in a memory 109*a* for later use. For instance the color and/or brightness parameter is stored as a color vector describing the color and brightness of a target color, $\overrightarrow{TC}$ $$\overrightarrow{TC} = \begin{bmatrix} X_T \\ Y_T \\ Z_T \end{bmatrix} \quad \text{Eq. 2}$$

where $X_T$, $Y_T$, $Z_T$ are tristimulus values according the CIE 1931 color space. In step 407, the voltage ($V_a$, $Y_b$) across the first and second LEDs are obtained 409 from voltage measuring means (not shown) and a values indicative of the first and second voltage are stored 411 in a memory. In step 413 the current ($I_a$, $I_b$) through the first and second LEDs are obtained 415 for instance from current measuring means (not shown); from the first 119*a* and the second 119*b* control signals from the LED drivers 113*a* or 113*b*, form the LED drivers 113*a* and 113*b* or obtained from/within the processor, A value indicative of the current are is stored 417 in a memory.

In step 419 colorimetric properties of the first and second LED are obtained from a first and second current-voltage model stored in a memory 109*b* (illustrated as a separate memory 109*b* by the skilled person realize the memory may be identical to the memory 109*a* wherein the other parameters are stored). The voltage and current parameters previously obtained and stored are used as input parameters as illustrated by arrow 421 and first colorimetric properties and second colorimetric properties related to the light emitted from the first and second LED are returned 423. The first and second colorimetric properties may for instance be indicated as a first $\overrightarrow{C_a}$ and second $\overrightarrow{C_b}$ color vectors.

$$\overrightarrow{C_a} = \begin{bmatrix} X_a \\ Y_a \\ Z_a \end{bmatrix} \quad \text{Eq. 3}$$

$$\overrightarrow{C_b} = \begin{bmatrix} X_b \\ Y_b \\ Z_b \end{bmatrix} \quad \text{Eq. 4}$$

where $X_a$, $Y_a$, $Z_a$, $X_b$, $Y_b$, $Z_b$ are coordinates in the CIE 1931 color space.

In the step 425 a first and second activation signal respectively for the first LED and the second LED are generated. The activation signals are sent to the LEDs and used to activate the LEDs, whereby the LEDs generate light. In this embodiment the first and second activation signals are adapted to adjust 427*a*, 427*b* the intensity of the first 101*a* and second 101*b* LED as perceived by a human observer. The activation signals may for instance be a DC signal where that amplitude is regulated or PWM signal where the duty cycle is regulated in order to regulate the intensity of the first and second LEDs. In case of PWM regulating the first activation signal has a first duty cycle $D_a$ and the second activation has a duty cycle $D_b$ and in case of DC regulation the first activation signal has a first current level $C_a$ and the second activation a second current level $C_b$ The activation signals are determined based on the target color, the first and second color vector such that the first duty cycle and second duty cycle is optimized such that the sum of the first and second vector is as close to the target color as possible. Various techniques as known in the art of additive lightning can be when determine the first and second duty cycle or first and second current levels.

By generating the activation signals based on the target color, the first and second color vector provides a very accurate color adjustment, as the first and second color vectors are determined based on actually driving conditions of the first and second LEDs.

Decision 429 determined whether or not the illumination device must be turned off. If this decision is positive the illumination device is stopped in step 431. If the decision 429 is negative the method is repeated in order to regulate the generated color. Decision 433 determined whether or not a new input signal have been received by the illumination device. In the case that the decision 433 is positive the method is repeated from step 403 and the color is regulated according to a new target color received from the input signal. However if the decision 433 is negative the method is repeated from step 407 which simply results in the fact that the first and second activating signals is changed in response to an eventual change in voltage across and/or current through the LEDs. The result is that the illumination device automatically adjusted the activation signals to the LEDs if the current through and/or voltage across the LEDs changes, for instance due to changing environmental conditions. The result is that the color of the illumination device can be kept constant under varying environmental conditions.

Figure 5:
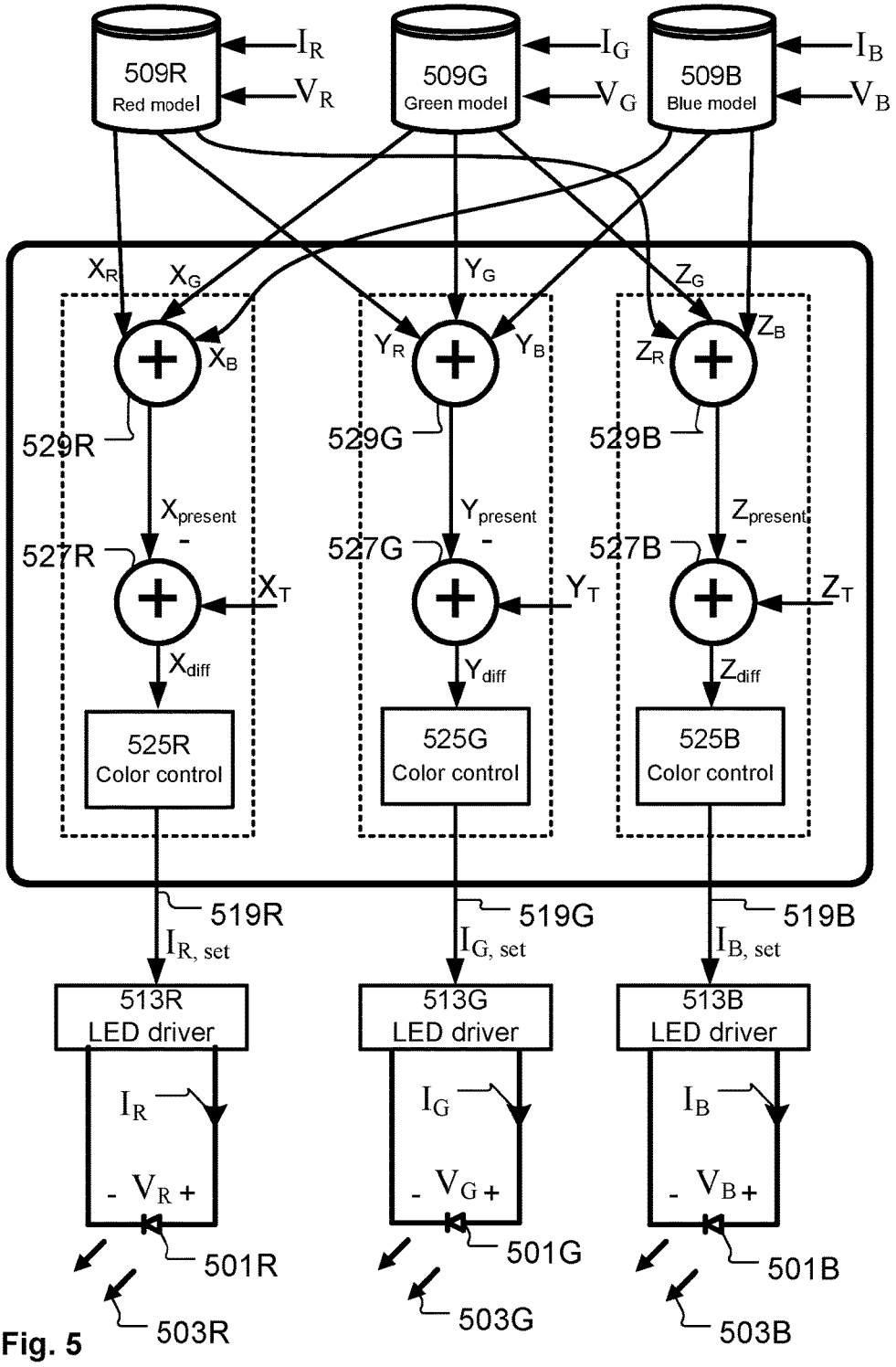
FIG. 5 illustrates a functional diagram of another illumination device according to the present invention.

FIG. 5 illustrates a functional diagram of an illumination device according to one aspect of the present invention. The illumination device comprises a first LED 501R emitting light 503R having a first color, a second LED 501G emitting light 503G having a second color and a third LED 501B emitting light 503B having a third color. In this embodiment the first color is red, the second color is green and the third color is blue. However the skilled person realizes that LED emitting other colors also can be used.

The first, second and third LEDs are respectively controlled by a first 513R, a second 513G and a third 513B LED driver adapted to activate the LEDs by amplitude regulating the current $I_R$, $I_G$, $I_B$ through the first, second and third LED.

The LED drivers are controlled by first, second and third control signal 519R, 519G, 5198 respectively indicative of the current $I_R$, $I_G$, $I_B$ that must be lead through the first, second and third LED.

The control signals 519R, 519B and 519B are generated respectively based on a first 525R, second 525G and third 525B color control method which is carried out by a processor.

The illumination device receives an input signal (not shown in FIG. 5) indicative of a target color expressed as target color vector as described in Eq. 2. The processor is adapted to pass the $X_T$, $Y_T$, $Z_T$ tristimulus values of the target color vector to respectively the first, second and third color control method. However the $X_T$, $Y_T$, $Z_T$ tristimulus values are not passed directly to the color control methods, as in summing function 527R, 527G and 525B the present tristimulus values of the illumination device $X_{present}$, $Y_{present}$, $Z_{present}$ are subtracted from the target $X_T$, $Y_T$, $Z_T$ tristimulus values. As a result a difference $X_{diff}$, $Y_{diff}$, $Z_{diff}$ between the target tristimulus values and the present tristimulus values are passed to respectively first, second and third color control methods 525R, 525G, 525B which generates the first, second and third control 519R, 519G, 519B indicative of the current $I_{R,set}$, $I_{G,set}$, $I_{B,set}$ that must be lead through the first, second and third LED.

The present tristimulus values $X_{present}$, $Y_{present}$, $Z_{present}$ of the illumination device are derived based on a first, second and third current-voltage model stored in memories 509R, 509G and 509B. (the memories are illustrated as separate memories for sake of simplicity, however the skilled person realizes that the current-voltage modes can be sorted in the same memory.) As described above the current-voltage modes make it possible to very accurately to predict colorimetric properties of a LED based on the voltage across and current through the LED. In the illustrated embodiment the output of the first, second and third current-voltage models are respectively a first $\overrightarrow{C_R}$, second $\overrightarrow{C_G}$ and third $\overrightarrow{C_B}$ color vectors:

$$\overrightarrow{C_R} = \begin{bmatrix} X_R \\ Y_R \\ Z_R \end{bmatrix} \quad \text{Eq. 5}$$

-continued $$\overrightarrow{C_G} = \begin{bmatrix} X_G \\ Y_G \\ Z_G \end{bmatrix} \quad \text{Eq. 6}$$

$$\overrightarrow{C_B} = \begin{bmatrix} X_B \\ Y_B \\ Z_B \end{bmatrix} \quad \text{Eq. 7}$$

The $X_R$, $X_G$ and $X_B$ tristimulus values are passed to summing function 529R where they are summed resulting in the present $X_{present}$ tristimulus values of the illumination device. The $X_{present}$ tristimulus value represents thus the X tristimulus value of the total light emitted by the illumination device since the contribution the X tristimulus values from all LED are summed.

Similar the $Y_R$, $Y_G$ and $Y_B$ tristimulus values are passed to summing function 529G where they are summed resulting in the present $Y_{present}$ tristimulus values of the illumination device. The $Y_{present}$ tristimulus value represents thus the Y tristimulus value of the total light emitted by the illumination device since the contribution the Y tristimulus values from all LED are summed.

Further the $Z_R$, $Z_G$ and $Z_B$ tristimulus values are passed to summing function 529B where they are summed resulting in the present $Z_{present}$ tristimulus values of the illumination device. The $Z_{present}$ tristimulus value represents thus the Z trisitimulus value of the total light emitted by the illumination device since the contribution the Z tristimulus values from all LED are summed.

The difference $X_{diff}$, $Y_{diff}$, $Z_{diff}$ between the target tristimulus values and the present tristimulus values are passed to the first, second and third color control functions and can be expressed as:

$$X_{diff}=X_T-X_R-X_G-X_B \quad \text{Eq. 8}$$

$$Y_{diff}=Y_T-Y_R-Y_G-Y_B \quad \text{Eq. 9}$$

$$Z_{diff}=Z_T-Z_R-Z_G-Z_B \quad \text{Eq. 10}$$

first, second and third color generating function which generates the first, second and third control 519R, 519G, 519B indicative of the current $I_{R,set}$, $I_{G,set}$, $I_{B,set}$ that must be lead through the first, second and third LED.

The first LED 501R is emitting red light 503R and provides the biggest contribution the present $X_{present}$ tristimulus value. The $X_{present}$ tristimulus value can thus be regulated most efficiently by regulating the intensity of the first LED. For instance in the case that $X_{diff}$ is negative more red light is needed in on order to achieve the $X_T$ tristimulus value of the target color. As a consequence the first color control function adjusts the first control signal 519R so it is indicative of the current through the first LED 501R and the $I_{R,set}$ value is larger than the present current $I_R$ through the first LED 501R. Further in the case that $X_{diff}$ is positive indicates that less red light is needed in order to achieve the $X_T$ tristimulus value of the target color. As a consequence the first color control function 525R adjusts the first control signal 519R so it is indicative of the current through the first LED 501R and the $I_{R,set}$ value is smaller than the present current $I_R$ through the first LED. On the other hand the first color generating function will not adjust the first control signal 519R in the case that $X_{diff}$ is zero, which indicates that the illumination device already are emitting light having a X tristimulus value matching the $X_T$ tristimulus target value.

The present $X_{present}$ tristimulus value is determined based on both the first, second and third current-voltage functions and the contribution to the X tristimulus value of light form the second and third LED are thus accounted for when adjusting the first LED.

The second LED 501G is emitting green light 503G and provides the biggest contribution the present $Y_{present}$ tristimulus value and the $Y_{present}$ tristimulus value can thus be regulated most efficiently by regulating the intensity of the second LED. Similar to the first LED the second control signal will be indicative of an increasing current through the second diode $I_{G,set}$, if the $Y_{diff}$ is negative, indicative of an decreasing current through the second diode if the $Y_{diff}$ is positive and maintain the current through the second diode at the same level if the $Y_{diff}$ is zero.

The third LED 501B is emitting blue light 503B and provides the biggest contribution the present $Z_{present}$ tristimulus value and the $Z_{present}$ tristimulus value can thus be regulated most efficiently by regulating the intensity of the third LED. Similar to the first and second LED the third control signal will be indicative of an increasing current through the third diode $I_{B,set}$, if the $Z_{diff}$ is negative, indicative of a decreasing current through the second diode if the $Z_{diff}$ is positive and maintained the current through the third diode at the same level if the $Z_{diff}$ is zero.

The first, second and third LEDs contribute to all XYZ tristimulus values of the light emitted by the illumination device and the contribution from each of the LEDs are account for when controlling the illumination device. The described process will be repeated continuously while the illumination deice is turned on and the illumination device will thus continuously regulated the intensity of the first, second and third LED. As a consequence the color of the light emitted by the illumination device is regulated based on the target color and further regulated based on the driving conditions (I, V) of the LEDs whereby a very accurate color adjustment of the illumination device is achieved. This is achieved as the current-voltage functions provides a very accurate feedback of the present XYX tristimulus values to the controlling means. Further if the driving conditions of one of the LED change during operation the illumination device is capable of controlling the intensity of the first, second and third LEDs in response to this change, whereby it is possible keep the same color even under changing driving conditions.

The color vectors provided by the current-voltage models are determined based on the present current through and voltage across the LEDs. The current and voltage across the LEDs can be obtained by using measuring means as known in the art of electronic measuring means. However in the illustrated embodiment the current through the LEDs are controlled by the LED drivers 513R, 513F, 513B based on the controlling signals 519R, 519G, 519B indicative of the current through the LED. This makes it possible to use the controlling signals as input to the current-voltage models instead of measuring the current through the LED.

In the illustrated embodiment the activation signals regulating the intensity of the LED are DC signals where the current level are regulated in order to regulate the intensity of the LEDs. However the person skilled in the art realize that the activation signal alternatively a PWM signal where the intensity of the LED is regulated by regulating the duty cycle of the PWM signal.

Figure 6:
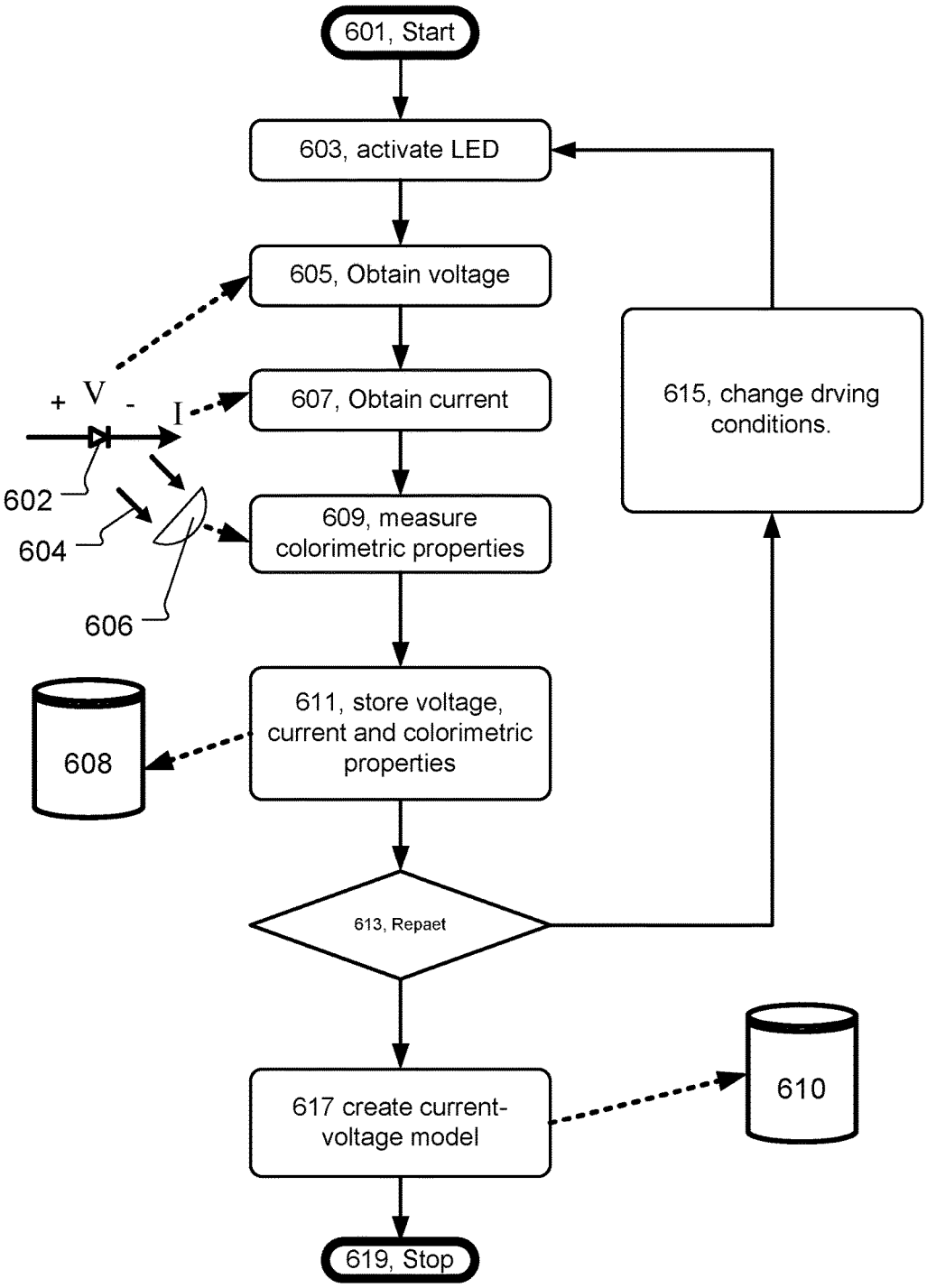
FIG. 6 illustrates a flow diagram of a method of calibrating an illumination device according to the present invention.

The present invention relates also to a method of calibrating an illumination device comprising a number of LEDs emitting light. FIG. 6 illustrates a flow diagram of the method starting with a predetermined initialization in step 601. The predetermined initialization can for instance include a warm-up period where the LEDs are activated for a predetermined period of time in order to reach the typical operating temperature of the illumination device. Once the initialization step 601 has been complete the calibration method is started by activating 603 the LED 602 whereby the LED emits light 604. The step of activating the LED is performed at a first driving condition. In step 605 the voltage across the LED is obtained, for instance by measuring the voltage or by driving the LED a predetermined voltage level. In step 607 the current through the LED is obtained, for instance by measuring the current or by driving the LED a predetermined current level. In step 609 the colorimetric properties are measured using a spectral measuring device 606 capable of measuring colorimetric properties of the emitted light.

In step 611 the obtained current, the obtained voltage and the measured colorimetric properties are stored as a calibration point in a memory 608 for later use.

The previous steps 603, 605, 607, 609 are then repeated 613 a number of times under different driving conditions of the LEDs. As a consequence the step 615 of changing the driving conditions is performed before executing the previous steps 603, 605, 607, 609. The driving conditions can be change in many different ways and serve to ensure that the illumination device is calibrated under different driving conditions which improved the validity of the calibration. For instance the driving conditions can be changed by changing the current through the LED e.g. by increasing or decreasing the current through the LED and the voltage across the LED would automatically change when the current is changed. The driving conditions can also be changed by changing the voltage the LED e.g. by increasing or decreasing the voltage across the LED and the current through the LED would automatically changes. It is also possible to change the ambient temperature of the LED which results in the fact that the junction temperature of the LED changes and it is thus possible to obtain different voltages at the same current as the voltages typically drops at increasing temperature at the amount of current. The opposite is also possible where it is possible to obtain different currents at the same voltage.

For instance the current-voltage model described above was created by increasing both the current through the LED and the junction temperature of the LED. The junction temperature of the LED is regulated through a heat adjustable heat sink. However in typical illumination devices the heat sink is a passive heat sink and cannot be controlled. The junction temperature can thus not be varied through the heat sink. In this situation it is possible to place the illumination device in a room where the ambivalent temperature can be varied which makes it possible to vary the junction temperature, as the junction temperature depends on the ambient temperature. Typically this requires time to reach steady driving conditions as the temperature of the illumination device takes time to reaches steady state.

However it is possible to create calibration points at different junction temperature without regulating the ambient temperature. This can be achieved by starting the calibration method at a current which is just enough the make the LED emit light. The current is the gradually increased until it reaches the maximum current and the voltage and colorimetric properties of the emitted light are measured at a number of points while increasing the current. When the maximum current is reached the same calibration is repeated just thereafter from the lowest current. The heat sink temperature will increase as a result of the increasing current.

However it takes some time for the heat sink to cool down and the junction temperature of the LED will thus be increased when the second calibration is performed. As a consequence it is possible to obtain the current, the voltage and the colorimetric properties at different junction temperature. It is also possible to perform a similar calibration by varying the voltage across the LED.

A current-voltage model related to the LED is created in step 617 using the obtained number of calibration points. Typically the current-voltage model is stored in a memory 610 of the illumination device for instance as a look-up table or as a current-voltage function as described above.

It is noted that the calibration method can be carried out on each LED separately or be carried out on a number of LED which is driven by the same activation signals e.g. LED coupled in series or in parallel.

It is further noted that the illumination device, the controlling method and the calibration method according to the present invention method can be incorporated/embodied as an illumination device where the LEDs of different colors are coupled in series or in parallel and LED of the same color are controlled by the same activation signal.

The invention claimed is:

1. An illumination device comprising:

a number of LEDs emitting light;

means for receiving an input signal indicative of at least one of a color and a brightness; and means for generating an activation signal for at least one of said LEDs based on said input signal, wherein the illumination device comprises:

means for receiving a voltage across said at least one LED; and means for receiving a current through said at least one LED, and wherein the means for generating said activation signal is adapted to generate said activation signal based on said voltage, said current and a current-voltage model related to said at least one LED, wherein said current-voltage model defines a relationship between said current, said voltage and colorimetric properties of said light emitted by said at least one LED, wherein said colorimetric properties comprise values describing at least one of a color and spectra of said light, wherein said relationship is defined by a look up-table comprising a number of measured calibration points, and wherein each of said calibration points comprise a measured voltage across said LED, a measured current through said LED and measured colorimetric properties related to said light emitted by said LED.

2. The illumination device of claim 1, further comprising:

at least a first LED emitting light having a first color;

means for receiving a first voltage across said first LED;

means for receiving a first current through said first LED;

means for generating a first activation signal for said first LED based on said input signal, said first voltage, said first current and a first current-voltage model related to said first LED, where said first current-voltage model defines a relationship between said first current, said first voltage and the colorimetric properties of said light emitted by said first LED;

at least a second LED emitting light having a second color;

means for receiving a second voltage across said second LED;

means for receiving a second current through said second LED;

means for generating a second activation signal for said second LED based on said input signal, said second voltage, said second current and a second current-voltage model related to said second LED, where said second current-voltage model defines a relationship between said second current, said second voltage and the colorimetric properties of said light emitted by said second LED;

at least a third LED emitting light having a third color;

means for receiving a third voltage across said third LED;

means for receiving a third current through said third LED; and means for generating a third activation signal for said third LED based on said input signal, said third voltage, said third current and a third current-voltage model related to said third LED, where said third current-voltage model defines a relationship between said third current, said third voltage and the colorimetric properties of said light emitted by said third LED.

3. The illumination device of claim 2, wherein at least one of said means for generating said activation signals is further adapted to generate said activation signal based on at least one of said colorimetric properties of light emitted by another of said LEDs.

4. The illumination device of claim 1, wherein at least one of said activation signals is indicative of the current through said LED.

5. The illumination device of claim 1, wherein the activation signals is indicative of the voltage across said LED.

6. The illumination device of claim 1, further comprising a memory in which at least one of said current-voltage models is stored.

7. The illumination device of claim 1, wherein at least one of said received voltages across said at least one of said LEDs are received based on at least one of:

voltage measuring means connected to said LED;

said activation signal for said LED; and said current-voltage model related to said LED.

8. The illumination device of claim 1, wherein at least one of said received currents through said at least one LED are received based on at least one of:

current measuring means connected to said LED;

said activation signal for said LED; and said current-voltage model related to said LED.

9. A method of controlling an illumination device comprising a number of LEDs emitting light, the method comprising:

receiving an input signal indicative of at least a color and/or brightness;

generating an activation signal for at least one of said LEDs;

receiving a voltage across said LED; and receiving a current through said LED, wherein said activation signal is generated based on said input signal, said voltage, said current and a current-voltage model related to said LED, where said current-voltage model defines a relationship between said current, said voltage and colorimetric properties of light emitted by said LED, wherein said colorimetric properties comprise values describing at least one of a color and spectra of said light, and wherein said relationship is defined by a look up-table comprising a number of measured calibration points, wherein each of said calibration points comprises a measured voltage across said LED, a measured current through said LED and measured colorimetric properties related to said light emitted by said LED.

10. The method of claim 9, wherein:

receiving a voltage across said at least one LED comprises:

receiving a first voltage across a first LED, said first LED emitting light having a first color;

receiving a second voltage across a second LED, said second LED emitting light having a second color; and receiving a third voltage across a third LED, said third LED emitting light having a third color;

receiving a current through said at least one LED comprises:

receiving a first current through said first LED;

receiving a second current through said second LED; and receiving a third current through said third LED; and generating an activation signal for at least one of said LEDs comprises:

generating a first activation signal for said first LED based on said first voltage, said first current and a first current-voltage model related to said first LED, where said first current-voltage model defines a relationship between said first current, said first voltage and colorimetric properties of light emitted by said first LED;

generating a second activation signal for said second LED based on said second voltage, said second current and a second current-voltage model related to said second LED, where said second current-voltage model defines a relationship between said second current, said second voltage and colorimetric properties of light emitted by said second LED; and generating a third activation signal for said third LED based on said third voltage, said third current and a third current-voltage model related to said third LED, where said third current-voltage model defines a relationship between said third current, said third voltage and colorimetric properties of light emitted by said third LED.

11. The method of claim 10, wherein at least one of said steps of generating said activation signals is further adapted to generate said activation signal based on at least one of said colorimetric properties of light emitted by another of said LEDs.

12. The method of claim 9, wherein at least one of said activation signals is indicative of the current through at least one of said LEDs.

13. The method of claim 9, wherein at least one of said activation signals is indicative of the voltage across at least one of said LEDs.

14. The method of claim 9, wherein receiving voltages across at least one of said LEDs comprises:

measuring said voltage across said LED using voltage measuring means connected to said LED;

receiving said voltage across said LED based on said activation signal for said LED; and receiving said voltage across said LED based on said current-voltage model related to said LED.

15. The method of claim 9, wherein receiving current through at least one of said LEDs comprises:

measuring said current through said LED using current measuring means connected to said LED;

receiving said current through said LED based on said activation signal for said LED; and receiving said current through said LED based on said current-voltage model related to said LED.

16. An illumination device comprising:

a number of LEDs emitting light;

means for receiving an input signal indicative of at least one of a color and a brightness; and means for generating an activation signal for at least one of said LEDs based on said input signal, wherein the illumination device comprises:

means for receiving a voltage across said at least one LED; and means for receiving a current through said at least one LED, and wherein the means for generating said activation signal is adapted to generate said activation signal based on said voltage, said current and a current-voltage model related to said at least one LED, wherein said current-voltage model defines a relationship between said current, said voltage and colorimetric properties of said light emitted by said at least one LED, wherein said colorimetric properties comprise values describing at least one of a color and spectra of said light, wherein said relationship is defined by a current-voltage function, wherein said current-voltage function is defined based on a number of measured calibration points, and wherein each of said calibration points comprise a measured voltage across said LED, a measured current through said LED and measured colorimetric properties related to said light emitted by said LED.

17. The illumination device of claim 16, wherein the current-voltage function is a polynomial function, where the output of said polynomial function relates to the colorimetric properties of said LED and the inputs to said polynomial function are said voltage across and said current through said LED.

18. A method of controlling an illumination device comprising a number of LEDs emitting light, the method comprising:

receiving an input signal indicative of at least a color and/or brightness;

generating an activation signal for at least one of said LEDs, where said activation signal is generated based on said input signal;

receiving a voltage across said LED; and receiving a current through said LED, wherein said activation signal is generated based on said voltage, said current and a current-voltage model related to said LED, where said current-voltage model defines a relationship between said current, said voltage and colorimetric properties of light emitted by said LED, wherein said colorimetric properties comprise values describing at least one of a color and spectra of said light, wherein said relationship is defined by a current-voltage function, where said current-voltage function is defined based on a number of measured calibration points, and wherein each of said calibration points comprises measured voltage across said LED, a measured current through said LED and measured colorimetric properties related to said light emitted by said LED.

19. The method of claim 18, wherein the current-voltage function is a polynomial function, where the output of said polynomial function relates to said colorimetric properties of said LED and the inputs to said polynomial function are said voltage across and said current through said LED.

20. A method of calibrating an illumination device comprising a number of LEDs emitting light; the method comprising:

activating at least one of said LEDs at a driving condition;

receiving a current through said LED at said driving condition;

receiving a voltage across said LED at said driving condition;

measuring colorimetric properties of said light emitted by said LED at said driving condition, wherein said colorimetric properties comprise one or more values describing at least one of a color and spectra of said light;

storing said received current, said received voltage and said measured colorimetric properties as a calibration point;

changing said driving condition;

repeating a number of times said steps of activating said LED, receiving the current through said LED, receiving the voltage across said LED, measuring the colorimetric properties of said light emitted by said LED, storing said received current, said received voltage and said measured colorimetric properties as another calibration point and changing said driving conditions; and creating a current-voltage model related to said at least one LED by creating at least one polynomial function based on said number of calibration points.

21. The method of claim 20, wherein changing said driving conditions comprises:

changing the current through said LED;

changing the voltage across said LED; and changing the junction temperature of said LED.

22. An illumination device comprising:

a plurality of LEDs;

a LED driver receiving a voltage across at least one LED included in the plurality of LEDs, and receiving a current through the at least one LED; and a processor coupled to the LED driver, the processor receiving an input signal indicative of at least one of a color and a brightness, and generating an activation signal for the at least one LED based on the input signal, the voltage, the current, and a current-voltage model associated with the at least one LED, wherein the current-voltage model defines a relationship between the current, the voltage and colorimetric properties of light emitted by the at least one LED, wherein said colorimetric properties comprise values describing at least one of a color and spectra of said light, wherein said relationship is defined by a look up-table comprising a number of measured calibration points, and wherein each of said calibration points comprise a measured voltage across said LED, a measured current through said LED and measured colorimetric properties related to said light emitted by said LED.

* * * * *